US005628628A

United States Patent [19]

Kim et al.

[11] Patent Number: 5,628,628

[45] Date of Patent: May 13, 1997

[54] COMBUSTION DEVICE OF FAN HEATER

[75] Inventors: In K. Kim; Young S. Kim; Seock J. Kim; Sung H. Shim, all of Kyungsangnam-do, Rep. of Korea

[73] Assignee: Goldstar Co., Ltd., Seoul, Rep. of Korea

[21] Appl. No.: 380,709

[22] Filed: Jan. 30, 1995

[30] Foreign Application Priority Data

Sep. 3, 1994 [KR] Rep. of Korea ..... 22149/1994

[51] Int. Cl.[6] ..... F23D 11/44

[52] U.S. Cl. ..... 431/208; 431/214; 431/335

[58] Field of Search ..... 431/208, 214, 431/211, 335, 10, 207, 218; 126/93, 95, 97, 84

[56] References Cited

U.S. PATENT DOCUMENTS

| | | | |
|---|---|---|---|
| 1,158,668 | 11/1915 | Felten | 431/214 |
| 1,555,631 | 9/1925 | Brown | 431/208 |
| 1,639,744 | 8/1927 | Misch | 431/236 |
| 2,531,272 | 11/1950 | Horbetz | 431/207 |
| 5,156,543 | 10/1992 | Jeung | 431/208 |

FOREIGN PATENT DOCUMENTS

| | | | |
|---|---|---|---|
| 231312 | 12/1984 | Japan | 431/208 |
| 28651 | 3/1991 | Japan . | |

*Primary Examiner*—James C. Yeung
*Attorney, Agent, or Firm*—Fish & Richardson PC

[57] ABSTRACT

Combustion device of a kerosene fan heater, which can inhibit accumulation of tar inside of the carburetor and can improve a mixing efficiency of fuel of kerosene and air.

The combustion device includes a spraying means for spraying flammable substance, a vaporizing means for vaporizing the sprayed flammable substance before burning the flammable substance, and a dividing means disposed in the vaporizing means for dividing the sprayed flammable substance and making the divided flammable substance swirl in opposite direction to each other.

5 Claims, 4 Drawing Sheets

COMBUSTION DEVICE OF FAN HEATER

BACKGROUND OF THE INVENTION

1. Field of the Invention

This invention relates to a combustion device of a kerosene fan heater, which can inhibit accumulation of tar inside of the carburetor and can improve a mixing efficiency of fuel of kerosene and air.

2. Description of the Prior Art

In general, a kerosene fan heater, being a heater heating a room with a heat generated on combustion of vaporized fuel of kerosene, includes, as shown in FIG. 1, a fuel feeding device for feeding fuel, a combustion device for vaporizing and burning the fuel fed thereto by the fuel feeding device, and an air supply device for supplying air to the combustion device.

Explained in detail, the fuel feeding device includes a fuel feeding pipe 3 for guiding fuel fed from a cartridge tank through a oil metering tank 2, an electronic pump 4 connected to the fuel feeding pipe for pumping fuel fed through the fuel feeding pipe 3, a constant leveller 5 for maintaining a constant level of fuel pumped by the electronic pump, and a pipe orifice 6 provided inside of the constant leveller for guiding fuel to the combustion device.

And the combustion device includes an air supply passage 7 for guiding air supplied by the air supply device, a solenoid 9 mounted on the air supply passage for opening/closing supply of air to the constant leveller 5 of the fuel feeding device through a pressurizing tube 8, a nozzle 10 connected to the end of the air supply passage 7 for blowing air, a needle 11 connected to the end of the pipe orifice 6 of the fuel feeding device inserted in the nozzle for injecting fuel laden on air blowing from the nozzle 10, a carburetor 12 connected to the end of the nozzle 10 for vaporizing the fuel injected laden on air, a preheater 13 provided around the wall of the carburetor buried therein for preheating the carburetor 12, a preheat sensing thermistor 14 provided at the bottom of the carburetor 12 for sensing preheat temperature of the carburetor 12 preheated by the preheater 13, an ignition plug 15 for flying spark to the fuel gas vaporized in the carburetor preheated by the preheater 13, a burner head 16 covering top of the carburetor for burning fuel gas ignited by the ignition plug 15, a flame detector for detecting flame formed at the burner head, and a cooling jacket 19 formed surrounding the carburetor 12 for cooling the carburetor 12 with air supplied from the air supply passage 7 through a cooling tube 18.

In order to vaporize the fuel injected into the carburetor 12 laden on the blowing air, the fuel injected laden on the air should be made to swirl along inner wall of the carburetor 12, for which the end of the nozzle 10 is connected to the carburetor tangential to the inner wall of the carburetor 12.

And the air supply device includes a blower 20 for drawing in air form outside and blowing the air to the air supply passage 7 of the combustion device, and a filter 21 for filtering foreign particles from the air drawn in by the blower.

Accordingly, when the cartridge tank 1 filled with fuel is placed on the metering tank 2 of the fuel feeding device, the fuel filled in the cartridge tank i flows down into the metering tank 2 and stored therein.

Under the above condition, when a user turns on a power switch, a control part(not shown) controls the preheater 13 buried around the carburetor 12 to preheat the carburetor 12, and when the temperature sensed at the preheat sensing thermistor 14 of the carburetor is reached to a preset value, the control part stops preheating of the carburetor 12 and, on the same time, operates the blower 20 of the air supply part 20 and the electronic pump 4 of the fuel feeding device.

The operated blower 20 blows air cleared of various foreign particles through the filter 21, only through the air supply passage 7 and the nozzle 10 into the carburetor 12 for 20–30 seconds before ignition for cleaning inside of the carburetor 12, and the operated electronic pump 4 feeds the fuel from the metering tank 2 through the fuel feed pipe 3 to the constant leveller 5 that maintains a constant level of the fuel thereof.

In this time, the fuel maintaining a constant level in the constant leveller is, pressurized by a part of the air from the air supply passage 7 entered into the constant leveller 5 by continuous guide of the pressurizing tube 8 at opening of the solenoid 9 operated in response to a control signal of the control part, flows through the needle 11 guided by the pipe orifice 6, primarily atomized by and laden on the air blowing through the nozzle 10 into inside of the carburetor 12 even after the above 20–30 seconds of blowing for cleaning inside of the carburetor 12, fed into inside of the preheated carburetor 12.

And the fuel sprayed into the preheated carburetor 12 laden on air, swirls along the inner wall of the carburetor due to the tangential connection of the nozzle 10 to the inner wall of the carburetor, vaporizes into vaporized fuel gas by the heat of inner wall of the preheated carburetor 12, further mixes with air while swirling, and exhausts through the burner head 16 covering top of the carburetor when the fuel gas is ignited by the spark flying from the ignition plug 15 to form flame.

When the flame detector 17 detects formation of flame at ignition of fuel gas in initial stage of ignition and applies the signal on detection of flame, the control part, discriminates abnormal conditions of the applied flame detection signal, and if there are no abnormal conditions found, checks other safety devices, and controls to carry out a normal room heating.

However, since the conventional combustion device of a kerosene fan heater has a construction that makes the fuel fed into the carburetor through the needle laden on the air blowing through the nozzle vaporize as it swirls along the inner wall of the carburetor in one direction after it impinges onto the inner wall directly, the combustion device has following problems.

First, since the fuel that has not been vaporized on impinging at the inner wall of the carburetor vaporizes as it flows down from the wall to the bottom while forming oil film on the wall and the bottom, cooled part is concentrated at the wall and the bottom of the carburetor, causing a non-uniform difference of temperature distribution of 60 to 70 deg. C. for entire part of the carburetor, there has been a problem of safety at operation of the combustion device.

Second, since tar is formed at the bottom of the carburetor due to continuous formation of oil film on the concentrated cooled part where fuel can not vaporize instantaneously, and the tar once formed forms tar nuclei which deteriorates a heat transfer characteristic of the carburetor, causing excessive emission of unburned gas at ignition due to defective ignition and at extinction due to residual fuel inside of the tar as shown in FIGS. 6*a* and 6*b*, the room air becomes polluted with bad smell.

Third, the combustion noise is large and the combustion efficiency is low due to instability of flame because the vaporized fuel gas burns while exhausting through the burner head, under a condition that the vaporized fuel gas has not been mixed sufficiently with air through swirling within the carburetor since the swirling moment of the fuel injected into the carburetor laden on air blowing through the nozzle is weakened at impinging onto the inner wall of the carburetor.

SUMMARY OF THE INVENTION

The object of this invention is to provide a combustion device of a fan heater, which can solve the foregoing problems.

These and other object and features of this invention can be achieved by providing a combustion device of a fan heater, including a spraying means for spraying flammable substance, a vaporizing means for vaporizing the sprayed flammable substance before burning the flammable substance, and a dividing means disposed in the vaporizing means for dividing the sprayed flammable substance and making the divided flammable substance swirl in opposite direction to each other.

BRIEF DESCRIPTION OF THE DRAWINGS

FIGS. 6*a* and 6*b* are graphs showing quantity of unburned gas generated in kerosene fan heaters equipped with a conventional device and a device in accordance with this invention as a reference, wherein FIG. 6*a* is comparison of generated unburned gas at ignition.

FIG. 6*b* is comparison of generated unburned gas at extinction.

DETAILED DESCRIPTION OF THE EMBODIMENT

Figure 1:
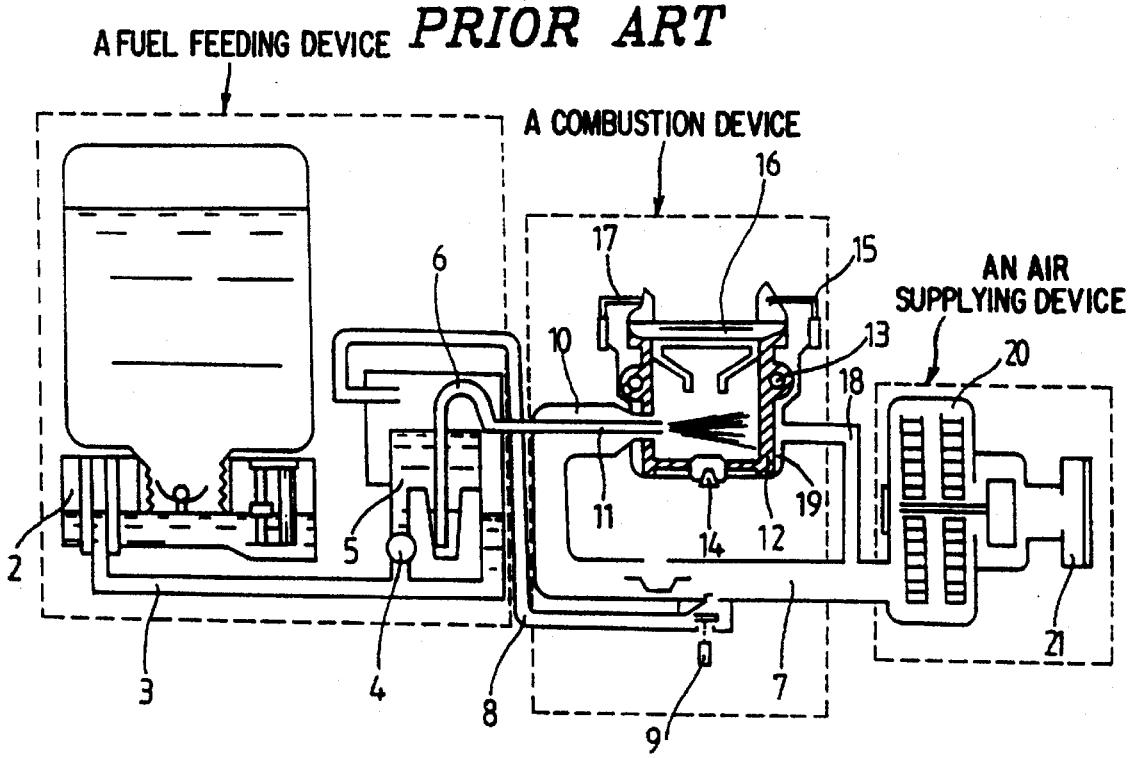
FIG. 1 PRIOR ART
FIG. 1 is a schematic over all illustration of a conventional kerosene fan heater.
Figure 2:
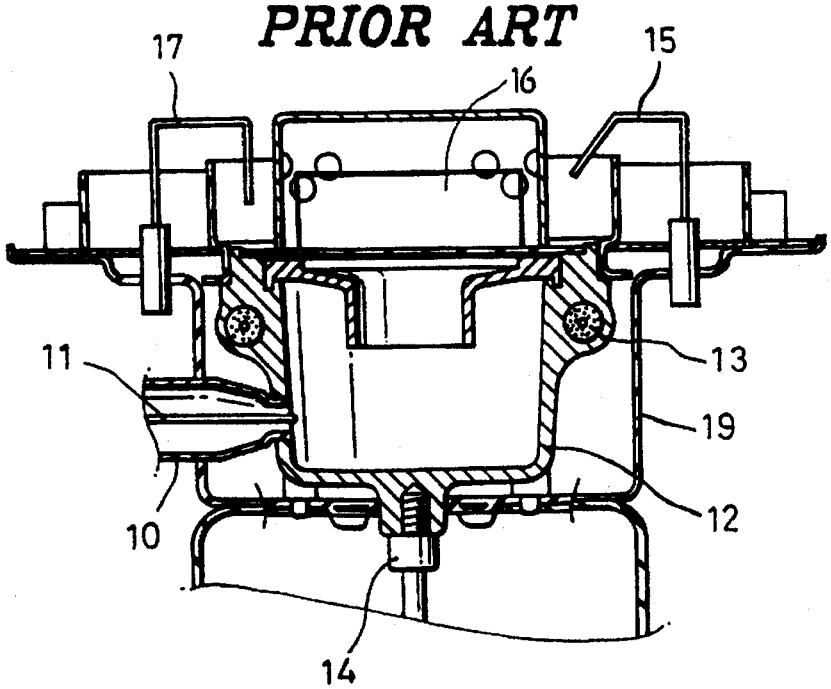
FIG. 2 PRIOR ART
FIG. 2 is a longitudinal section showing a principal part of a combustion device of the conventional kerosene fan heater.
Figure 3:
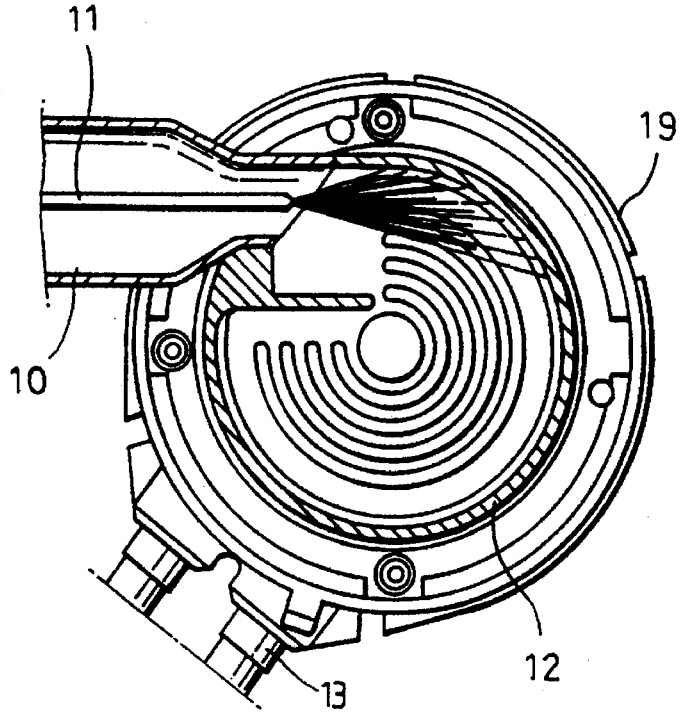
FIG. 3 PRIOR ART
FIG. 3 is a cross section showing a principal part of the combustion device of the conventional kerosene fan heater.
Figure 4:
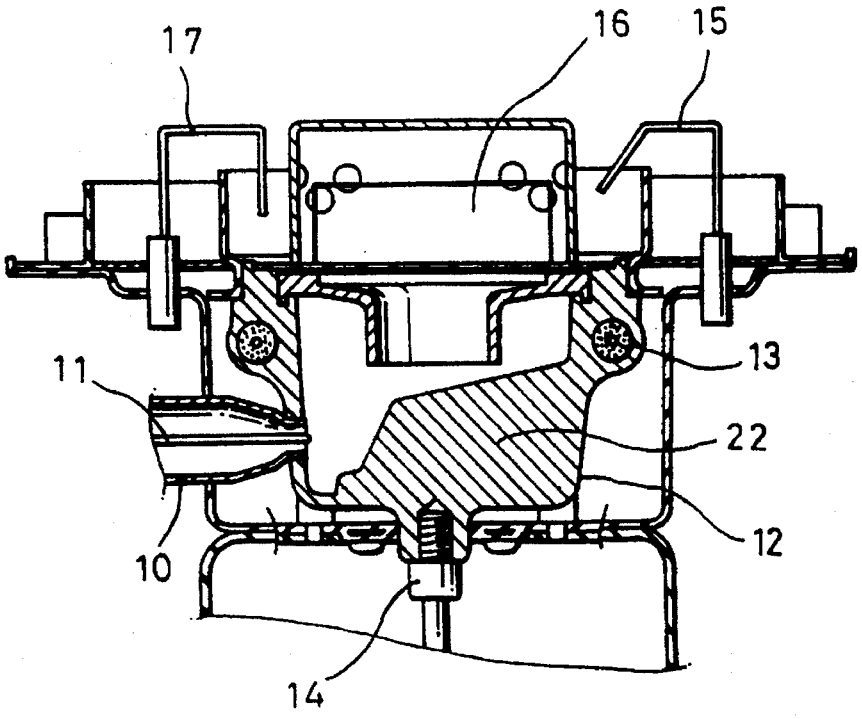
FIG. 4 is a longitudinal section showing a principal part of a combustion device off a kerosene fan heater in accordance with this invention.
Figure 5:
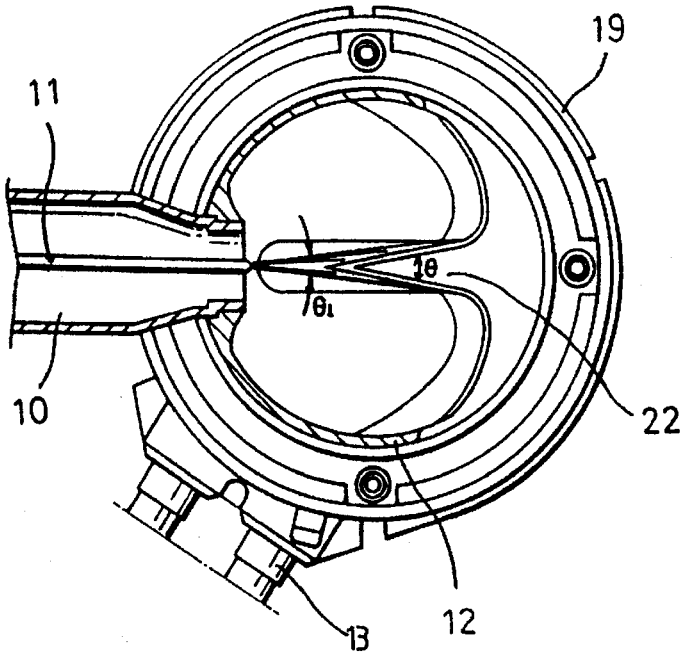
FIG. 5 is a cross section showing a principal part of the combustion device of the kerosene fan heater in accordance with this invention.

The attached drawings of FIG. 4 is a longitudinal section showing a principal part of a combustion device of a kerosene fan heater in accordance with this invention, and FIG. 5 is a cross section showing a principal part of the combustion device of the kerosene fan heater in accordance with this invention.

Of the system explanation of this invention, the part identical to the conventional system which has been explained already will be omitted hereinafter, and the same reference number with the conventional one will be used in the drawings.

One embodiment of the spraying means includes a needle for feeding fuel, and a nozzle 10 having the needle inside for blowing air under a constant pressure for primary atomization of the fuel fed through the nozzle.

One embodiment of the vaporizing means includes a carburetor 12 connected to the nozzle 10 for secondary vaporization of the primary atomized fuel-air mixture.

One embodiment of the dividing means includes a dividing piece 22 which has a sharp edge facing the nozzle in radial direction of the vaporizing means and smooth curvatures at the connection with the vaporizing means on opposite side of the sharp edge.

The dividing means is to be explained hereinafter in detail.

The nozzle 10 is connected at the outer circumference of the carburetor in radial direction, thereby the air blowing into the carburetor through the nozzle 10 sprays the fuel fed through the needle 11, and the dividing piece 22 having a sharp edge facing the nozzle in radial direction of the carburetor and smooth curvatures at the connection with the carburetor on opposite side of the sharp edge is provided integrated with the carburetor inside of the carburetor, thereby the fuel sprayed into radial direction of the carburetor 12 laden on the air blowing through the nozzle 10 is, atomized at being divided into two parts at the dividing piece 22, and mixed with air at swirling along the inner walls of the carburetor 12 in opposite directions.

The dividing piece 22 may not be integrated with the carburetor 12 inner wall and at times, it may be formed separated from the carburetor 12 and fixed to the inner wall of the carburetor.

Meantime, in plan view, end part of the dividing piece 22 forms an isosceles triangle on a radial line of the carburetor 12, and the angle θ of the end part of the dividing piece 22 is formed to be within ±10% of fuel spray stream angle θ1 to be sprayed into the carburetor 12 laden on air, thereby the fuel sprayed laden on air is made to be divided smoothly into two parts by the dividing piece 22.

Operation and advantage of one embodiment of this invention having the foregoing construction is to be explained hereinafter.

Since the air supplied by the air supply means is, guided through the air supply passage 7, blown into carburetor in radial direction through the nozzle 10 connected to the carburetor 12, whereas the fuel in the constant leveller 5 pressurized by air pressure is, guided to the pipe orifice 6, fed into the carburetor through the needle 11, the fed fuel is, laden on the blowing air, sprayed as it primarily atomizes, rapidly divided into two parts by the dividing piece 22 either formed integrated with the carburetor 12 at the inner wall thereof facing the nozzle 10 or formed separated from the carburetor 12 and fixed thereto, and vaporizes instantaneously on the preheated surface as it flows down both side walls of the dividing piece.

The reason why the sprayed fuel is rapidly divided into two parts by the dividing piece 22 is because end part of the dividing piece 22 forms an isosceles triangle in plan view positioned in radial direction of the carburetor facing the nozzle with the isosceles angle formed within ±10% of the stream angle of the sprayed fuel.

When the isosceles angle forming end part of the dividing piece 22 is over +10% of the stream angle of the sprayed fuel, since the sprayed droplets of fuel can not impinge onto all over the isosceles surface of the dividing piece 22, not allowing to absorb sufficient heat required for vaporization, the vaporization becomes unstable, and when the isosceles angle forming end part of the dividing piece 22 is not over −10% of the stream angle of the sprayed fuel, since part of the sprayed droplets of fuel can not impinge onto all over the isosceles surface of the dividing piece 22, but directly impinge on the smooth curves of the dividing piece, not allowing to absorb sufficient heat required for vaporization, the vaporization becomes unstable, it is the most desirable to have the isosceles angle forming end part of the dividing piece 22 to be within ±10% of the stream angle of the sprayed fuel.

The flammable fuel gas vaporized through the foregoing process flows divided by the dividing piece 22 until it reaches the smoothly curved parts of the dividing piece 22 where it starts to swirl in opposite direction to each other as it mixes with air and exhausts through the burner head 16 when the fuel gas, ignited by the spark flying from the ignition plug 15, forms flame.

When flame is formed by the vaporized fuel gas ignited through the foregoing operation, the flame detector 17 detects initial ignition flame and transmits it to the control part, and the control part checks the flame detection signal of being any abnormal condition, if found no abnormal condition, it further checks other safety devices, and thereafter carries out a normal combustion to heat a room.

Accordingly, this invention has following various advantages by the features of this invention, including a system in which fuel is sprayed laden on air blowing into a carburetor in radial direction, most of the sprayed fuel is atomized as it divided at the dividing piece, and only the atomized gas is mixed with air as it swirls along inner walls of the carburetor in opposite direction to each other.

First, since most of the fuel sprayed into the carburetor is vaporized on the dividing piece as it is divided at the dividing piece, fuel does not flow down to the bottom, and the difference of temperature distribution on all over the carburetor is not so great, the system is safe.

Figure 6A:
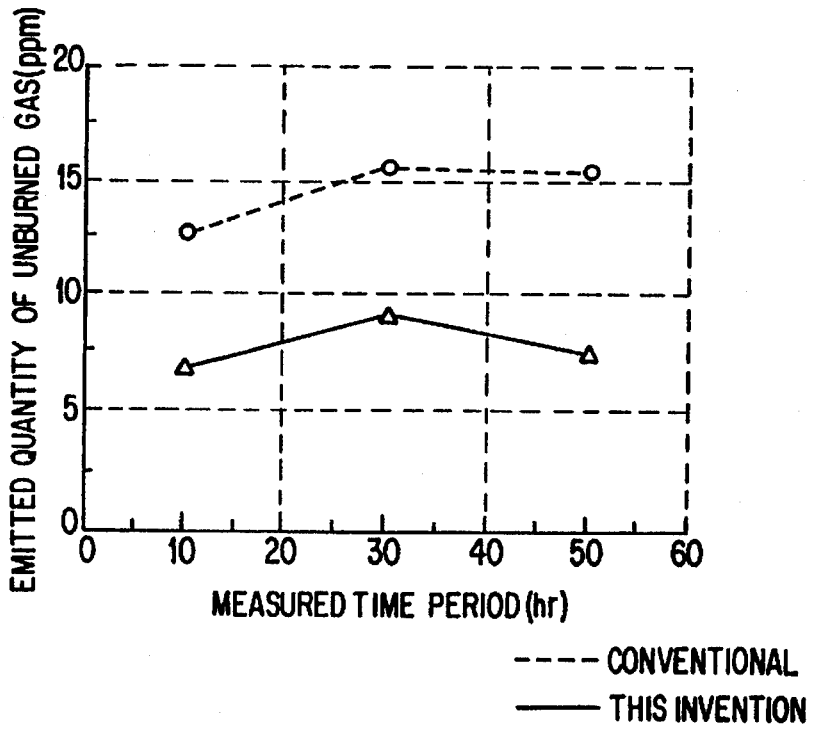
Figure 6B:
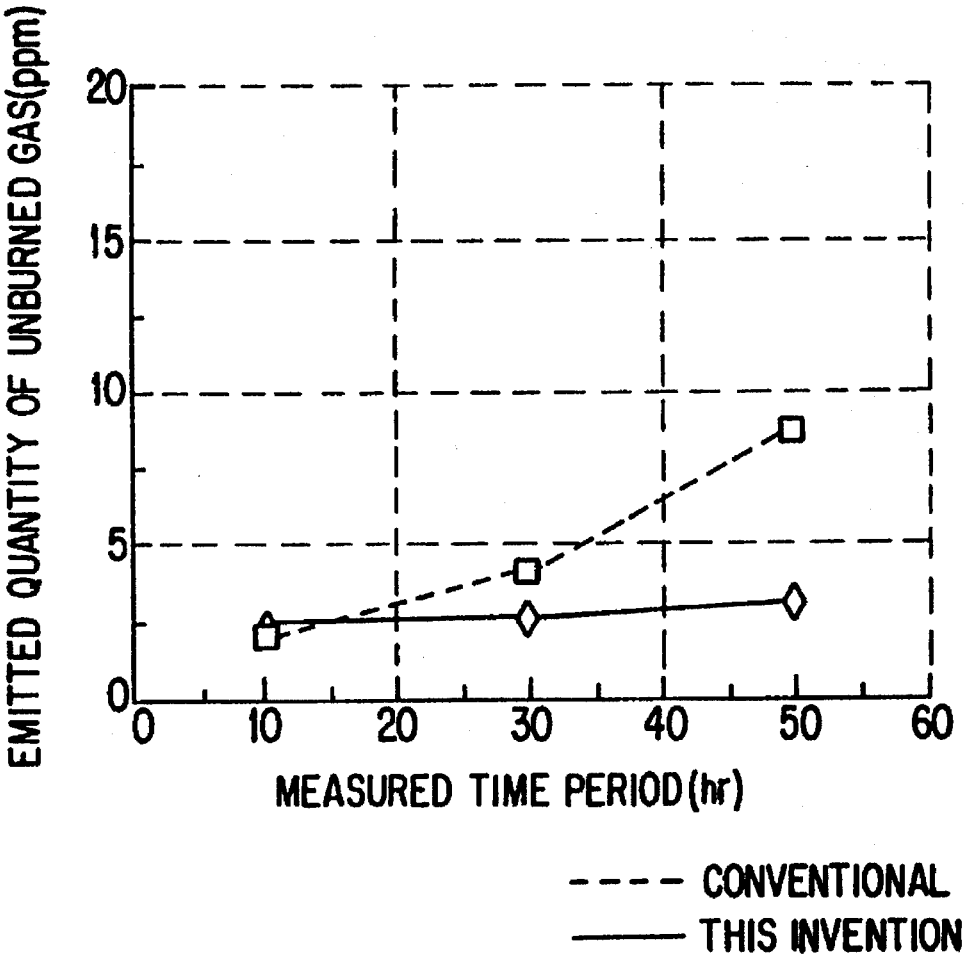

Second, as formation of tar at the bottom of the carburetor is not liable, generation of unburned gas is inhibited at ignition and at extinction as shown in FIGS. 6*a* and 6*b*, and it becomes possible to reduce pollution of room air.

Third, since the swirling moment is stronger, the vaporized fuel gas and air can be mixed sufficiently before it burns and exhausts through the burner head, whereby there can be less noise with improved efficiency.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. A carbulator device for a combustion fan heater comprising:

a spraying means including a nozzle for spraying a flammable substance;

a vaporizing means including a carbulation chamber having walls for vaporizing a flammable substance sprayed from said nozzle for burning the flammable substance, wherein said nozzle is positioned adjacent a wall of said carbulation chamber, said nozzle having a spraying direction facing a center part of said carburation chamber; and, a dividing means, including a dividing piece with a sharp edge facing said nozzle and having sides in a generally triangular shape connected with said walls of said carburation chamber and forming a generally triangular shaped cross section in plan view with said sharp edge extending radially towards said center part of said carburation chamber with said sides merging smoothly with said walls of said carburation chamber on each side of said sharp edge for dividing a flammable substance sprayed from said nozzle into two parts and making the two parts of the divided flammable substance mix with air and swirl in opposite directions to each other.

2. A carburation device for a combustion fan heater as claimed in claim 1, wherein said triangularly shaped dividing piece forms a triangle with generally the shape isosceles triangle.

3. A carburetor device for a combustion fan heater as claimed in claim 1, wherein said dividing piece is integrally connected with said walls of said carburation chamber.

4. A carburetor device for a combustion fan heater as claimed in claim 2, wherein said dividing piece is integrally connected with said walls of said carburation chamber.

5. A carburetor device for a combustion fan heater as claimed in claim 1, wherein said spraying means sprays a flammable substance having a stream angle and wherein said sharp edge dividing piece has an included angle which is within plus or minus 10% of the stream angle of a flammable substance sprayed from said spraying means.

* * * * *